US005378959A

United States Patent [19]

Mancini

[11] Patent Number: 5,378,959

[45] Date of Patent: Jan. 3, 1995

[54] SHADOW MASK TYPE COLOR PICTURE TUBE WITH REDUCED MOIRE

[75] Inventor: Filippo Mancini, Rome, Italy

[73] Assignee: Videocolor, S.p.A., Anagni, Italy

[21] Appl. No.: 12,206

[22] Filed: Feb. 2, 1993

[30] Foreign Application Priority Data

Feb. 20, 1992 [IT] Italy ..... MI92 A 000378

[51] Int. Cl.[6] ..... H01J 29/07

[52] U.S. Cl. ..... 313/402; 313/403; 313/407

[58] Field of Search ..... 313/402, 403, 407

[56] References Cited

U.S. PATENT DOCUMENTS

| | | | |
|---|---|---|---|
| 3,633,058 | 1/1972 | Kouno | 313/403 |
| 3,663,854 | 5/1972 | Tsuneta et al. | 313/403 |
| 3,973,159 | 8/1976 | Barten | 313/403 |
| 4,210,842 | 7/1980 | Nakayama et al. | 313/403 |
| 4,751,425 | 6/1988 | Barten | 313/403 |
| 4,983,879 | 1/1991 | Kawaguchi | 313/402 |

*Primary Examiner*—Sandra L. O'shea
*Attorney, Agent, or Firm*—Joseph S. Tripoli; Dennis H. Irlbeck

[57] ABSTRACT

An improved color picture tube has a viewing screen, a shadow mask located adjacent to the screen, and an electron gun for generating and directing a plurality of electron beams through the mask to the screen. The mask has a rectangular periphery with two long sides and two short sides. A major axis passes through the center of said mask and parallels the long sides, and a minor axis passes through the center of the mask and parallels the short sides. The mask includes slit-shaped apertures aligned in columns that essentially parallel the minor axis. Adjacent apertures in each column are separated by tie bars in the mask. The beams are scanable over the screen in scanning lines that parallel the major axis. The improvement comprises the length of the apertures, measured in the direction of the minor axis, being approximately equal to a multiple of the center-to-center distance between adjacent scanning lines, measured in the direction of the minor axis.

3 Claims, 7 Drawing Sheets

SHADOW MASK TYPE COLOR PICTURE TUBE WITH REDUCED MOIRE

This invention relates to color picture tubes of a type having shadow masks with slit-shaped apertures, wherein the apertures are aligned in columns and the apertures in each column are separated by tie bars in the mask, and particularly to such a tube having a shadow mask with aperture lengths selected to permit optimum moiré performance on the viewing screen of the tube.

BACKGROUND OF THE INVENTION

A predominant number of color picture tubes in use today have line screens and shadow masks that include slit-shaped apertures. The apertures are aligned in columns, and the adjacent apertures in each column are separated from each other by webs or tie bars in the mask. Such tie bars are essential in the mask to maintain its integrity when it is formed into a dome-shaped contour which somewhat parallels the contour of the interior of a viewing faceplate of a tube. Tie bars in one column are offset in the longitudinal direction of the column (vertical direction)from the tie bars in the immediately adjacent columns. When electron beams strike the shadow mask, the tie bars block portions of the beams, thus causing shadows on the screen immediately behind the tie bars.

When the electron beams are repeatedly scanned in a direction perpendicular to the aperture columns (horizontal direction), this scanning results in a series of bright and dark horizontal lines on the screen. These bright and dark horizontal lines interact with the shadows formed by the tie bars, creating lighter and darker areas and producing a wavy pattern on the screen, called a moiré pattern. Such moiré pattern greatly impairs the visible quality of image displayed on the screen. It is highly desirable to select a moiré mode that will minimize the moiré pattern for any scan condition used in a television receiver. The two scan conditions presently in use are interlaced scan and noninterlaced scan. A moiré mode is the ratio of scan line pitch to tie bar shadow pitch. Because of the practical limitations of light output and mask strength, the moiré mode is usually chosen to be between 6/8 and 10/8. The moiré mode most frequently selected is 7/8. Such mode can be expressed by the equation:

$$\text{moiré mode} = \frac{T_s}{a_v},$$

where $T_s$ is the pitch or period of the scanning lines, which is equal to the vertical height, H, of the viewing screen divided by the number, $n_e$, of effective scanning lines for a given TV system: and $a_v$ is the vertical repeat distance of the mask apertures on the screen.

There is a possibility for use of a third scan condition. This third condition is called progressive scan and may be used on high definition television receivers. A higher scan frequency is necessary for progressive scan. In the special case of progressive scan, only one scan condition is considered to minimize the moiré pattern. This scan condition produces less moiré and a much smoother picture. For this condition, a moiré mode lower than 6/8 or higher than 10/8 would be used. The moiré mode most frequently selected for this condition is 5/8.

There have been many techniques suggested to reduce the moiré problem. Most of these techniques involve rearranging the locations of the tie bars in a mask to reduce the possibility of the electron beam scan lines beating with the tie bar shadows. Although many of these techniques have been used successfully in the past to reduce moiré, most of the prior techniques do not correct the moiré, problem in all parts of a screen, so that there is still a need for improved moiré reduction techniques. Such improved techniques are especially needed for the newer higher quality color picture tubes that are required for higher definition television. For example, as the quality of electron guns improves to meet the needs of higher definition television, such improved guns produce smaller electron beam spots at the screen. This reduction in electron beam spot size produces visually sharper scan lines on the screen which interact with the tie bar shadows and increase the moiré pattern problem.

SUMMARY OF THE INVENTION

An improved color picture tube, according to the present invention, has a viewing screen, a shadow mask located adjacent to the screen, and an electron gun for generating and directing a plurality of electron beams through the mask to the screens. The mask has a rectangular periphery with two long sides and two short sides. A major axis passes through the center of said mask and parallels the long sides, and a minor axis passes through the center of the mask and parallels the short sides. The mask includes slit-shaped apertures aligned in columns that essentially parallel the minor axis. Adjacent apertures in each column are separated by tie bars in the mask. The beams are scanable over the screen in scanning lines that parallel the major axis. The improvement comprises the length of the apertures, measured in the direction of the minor axis, being approximately equal to a multiple of the center-to-center distance between adjacent scanning lines, measured in the direction of the minor axis.

DETAILED DESCRIPTION OF THE PREFERRED EMBODIMENTS

Figure 1:
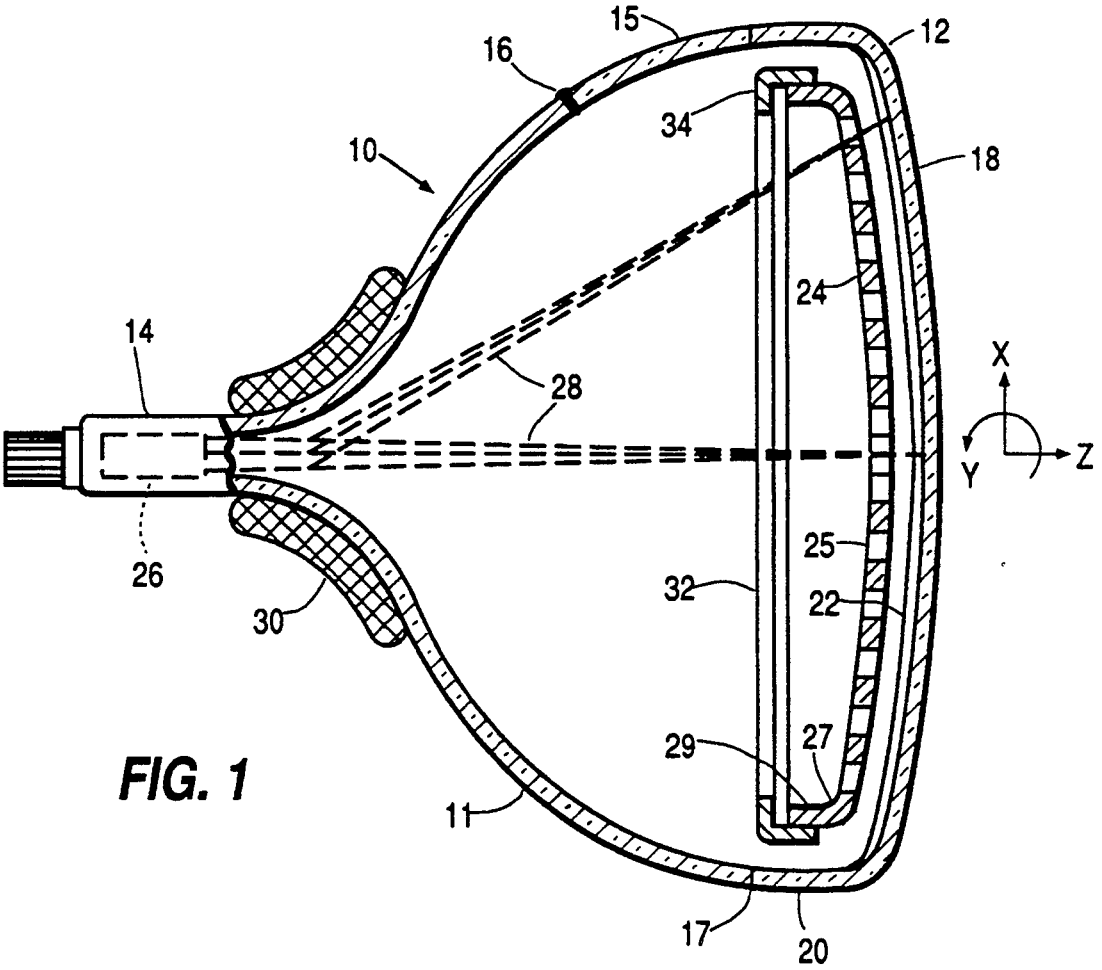
FIG. 1 is an axially sectioned side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14, to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1. The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within or over the frame 34, and the skirt portion 29 is welded to the frame 34.

Figure 2:
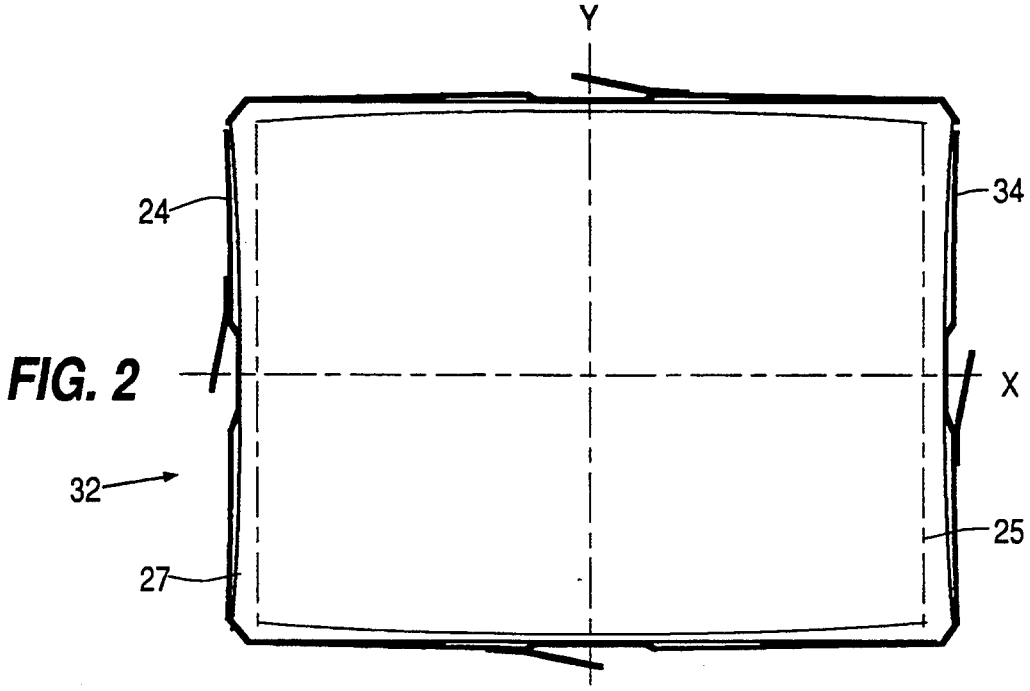
FIG. 2 is rear plan view of a mask-frame assembly of the tube of FIG. 1.
Figure 3:
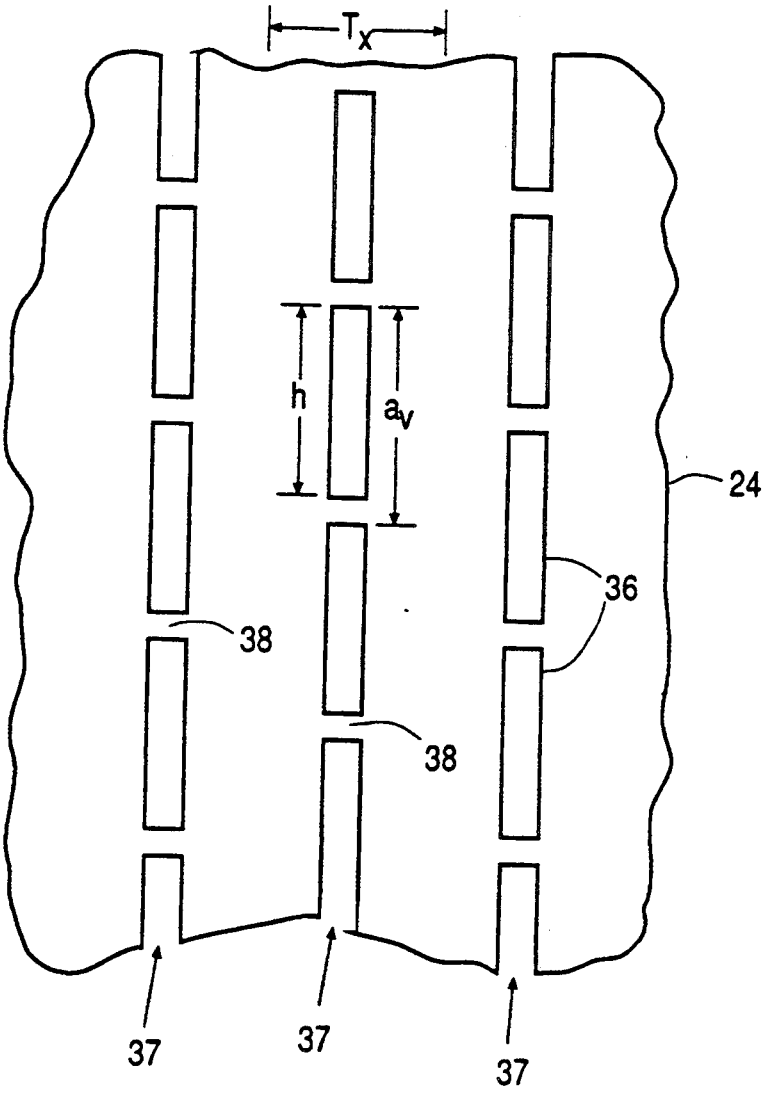
FIG. 3 is an enlarged view of a small portion of a shadow mask of the tube of FIG. 1.

The shadow mask 24, shown in greater detail in FIGS. 2 and 3, has a rectangular periphery with two long sides and two short sides. The mask 24 has a major axis X, which passes through the center of the mask and parallels the long sides, and a minor axis Y, which passes through the center of the mask and parallels the short sides. The mask 24 includes slit-shaped apertures 36 aligned in columns 37 that essentially parallel the minor axis Y. Adjacent apertures 36 in each column are separated by tie bars 38 in the mask, with the spacing between adjacent tie bars 38 in a column being defined as the tie bar pitch or vertical repeat $a_v$ at a particular location on the mask, as shown in FIG. 3. The aperture length is designated h.

The method of making the shadow mask 24 includes constructing an apertured flat mask which is later formed into a domed contoured mask. In a tube constructed in accordance with the present invention, a relationship between the length h of the slot-shaped apertures and the electron beam scanning line pitch $T_S$ is used which minimizes moiré. Such relationship is determined as follows.

The electron beam energy passing through the indicated mask aperture column is a periodic function of vertical location y, integrated in the horizontal direction x within an aperture column spacing of $T_x$, as indicated by the equation:

$$E_M(y) = \int_0^{T_x} f(x,y)dx \tag{1}$$

The beam energy $E_M(y)$ has a vertical period $T_Y$ equal to the vertical repeat $a_v$ of the mask apertures. This beam energy $E_M(y)$ may be expressed by a discrete Fourier series, as follow.

$$E_M(n) = \frac{1}{N}\sum_0^{N-1} kX_M(k)e^{J2\pi nk/N} \tag{2}$$

where:

$$J = \sqrt[2]{-1}$$

n=coordinate of a point in y direction, inside the $a_v$ repeat

N=total number of sampling points n used to define: the $a_v$ repeat $X_M(k)$=Fourier coefficients of k order.

Equation 2 can be rearranged to obtain the Fourier coefficients, $X_M(k)$, as follows.

$$X_M(k) = \sum_0^{N-1} nE_M(n)e^{-J2\pi nk/N}. \tag{3}$$

Figure 4:
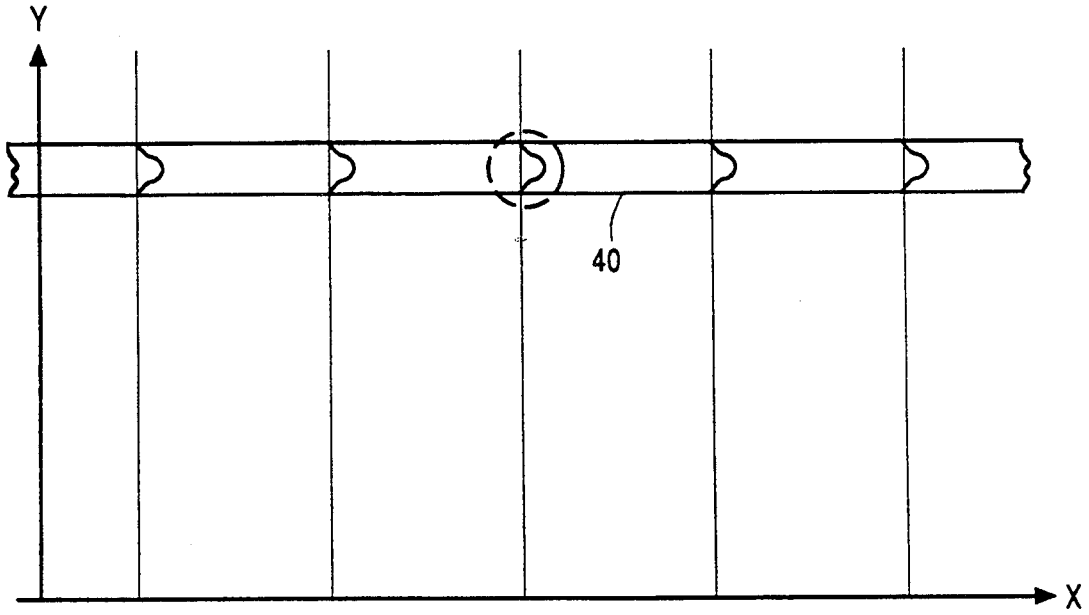
FIG. 4 is a view of a single electron beam scanning line showing the intensity distribution at a plurality of points.
Figure 5:
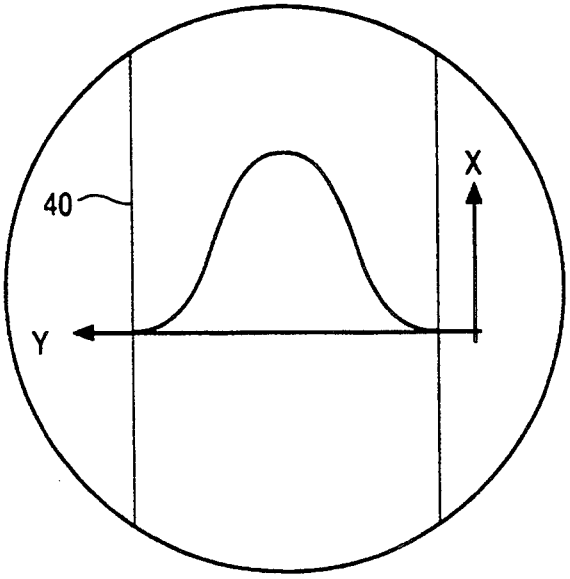
FIG. 5 is an enlarged view of the electron beam scanning line of FIG. 4.

FIGS. 4 and 5 show a single electron beam scanning line 40 as it is being scanned in the x direction across a mask. The energy distribution within the scanning line 40 is shown at a series of points in FIG. 4 and enlarged at a single point in FIG. 5. The energy distribution is somewhat bell-shaped with the peak of intensity being located at about the center of the scanning line. The mask is scanned with a series of such scanning lines which parallel the one shown.

Figure 6:
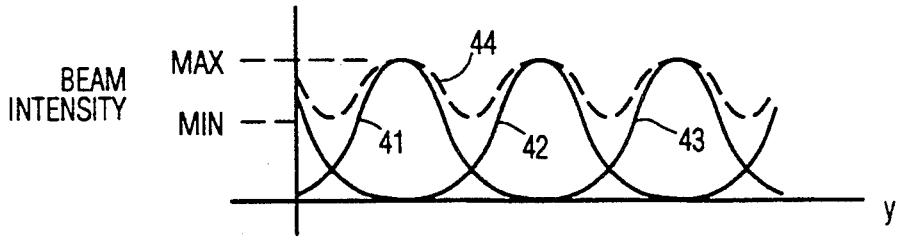
FIG. 6 is a graph of the intensity of two adjacent electron beam scanning lines and their resulting combined energy distribution.

Given uniform scanning lines of constant intensity, such as the scanning line 40 shown in FIG. 4, three consecutive adjacent scanning lines have overlapping energy distributions 41, 42 and 43, as shown in FIG. 6. Summing these three energy distributions provides a resulting energy distribution 44 which has a modulation factor m, defined in Equation 4 below, wherein $I_{MAX}$ and $I_{MIN}$ are maximum and minimum intensities, respectfully. The resulting energy distribution 44 is periodic in the y direction.

$$m = \frac{I_{MAX} - I_{MIN}}{1/2(I_{MAX} + I_{MIN})} \tag{4}$$

Figure 7:
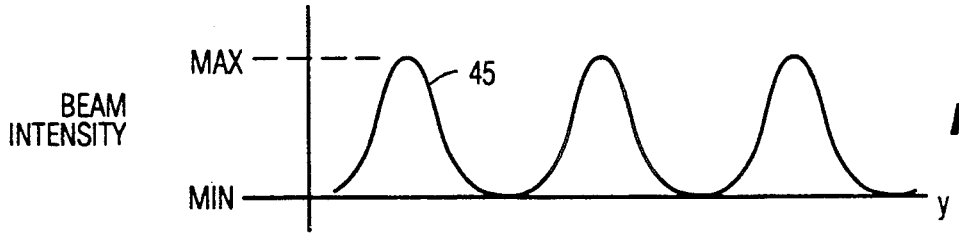
FIG. 7 is a graph of a combined energy distribution, such as in FIG. 6, having a large modulation.

FIG. 7 shows a special case of a resulting energy distribution 45 where the modulation factor m is very large. Such energy distribution can occur with a high quality electron gun having very finely focused electron beams. This case of large modulation factor m provides the most critical condition for the appearance of a large moiré effect on the tube screen.

Inasmuch as any periodic function can be expressed as the sum of sine and cosine functions, it can be assumed that the energy distribution s(n) in the y direction is a cosinusoidal function of points n, where sampling points n (in total N) belong to a line in the y direction:

$$s(n)=a+m\cos(w_s n+\Phi) \tag{5}$$

where: a=average intensity value of the television signal m=modulation factor $w_s$=pulse of the signal in the y direction; the corresponding spatial period being $$T_s=\frac{2\pi}{w_s}$$

$\Phi$=a phase value.

If the two periodic effects, i.e. the mask periodical energy transmission $E_M(n)$ and the television signal energy distribution s(n), are superimposed, Equation 6 is obtained.

$$E_M(n)s(n)=\left(\frac{1}{N}\sum_{0}^{N-1} kx_n(k)e^{J2\pi nk/N}\right)\{a+m\cos(w_s n+\phi)\}. \tag{6}$$

Figure 8:
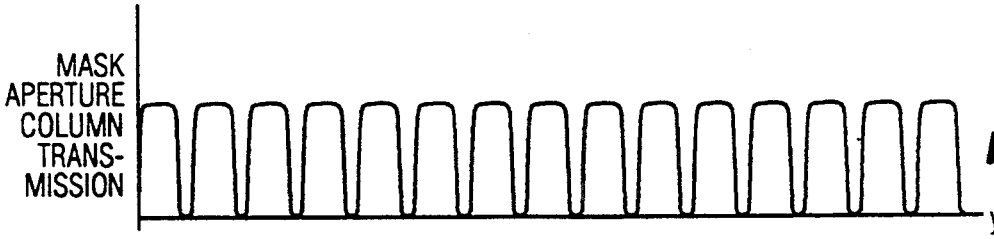
FIG. 8 is a graph showing a typical mask transmission pattern.

FIG. 8 shows a typical mask transmission pattern viewed vertically along one aperture column. The apertures permit transmission, and the tie bars block transmission. The peak-to-peak distance in FIG. 8 is the tie bar pitch $a_y$ discussed above.

Figure 9:
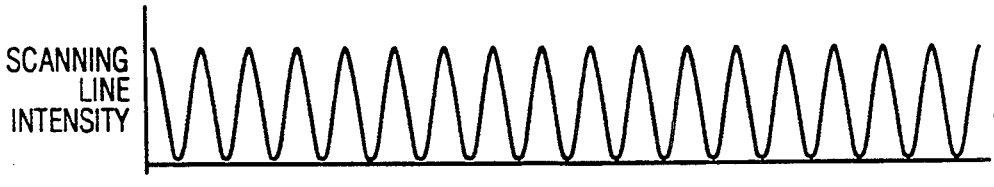
FIG. 9 is a graph showing a typical vertical, y, section of uniform television lines.

FIG. 9 shows a typical vertical y section, viewed at an aperture column, of uniform television signal scanning lines. The peak-to-peak distance in FIG. 9 is the center-to-center spacing $T_S$ between scanning lines.

Figure 10:
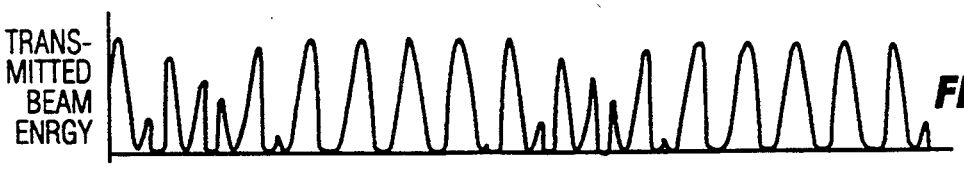
FIG. 10 is a graph showing the energy along a vertical mask column in the vertical direction.

FIG. 10 shows the electron beam energy that is transmitted through a particular aperture column as viewed vertically. It can be seen that some electron beam energy is blocked at each of the tie bars in the mask.

Figure 11:
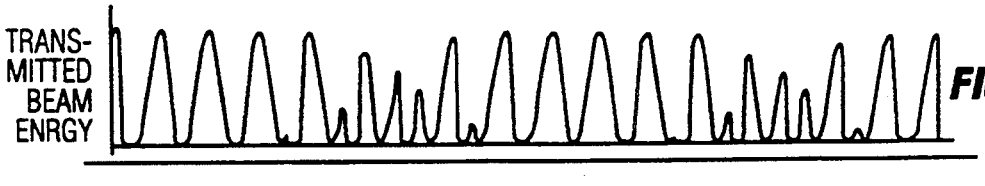
FIG. 11 is a graph showing the energy along a vertical mask column that is adjacent to the column of FIG. 10.

FIG. 11 shows the electron beam energy that is transmitted through an aperture column that is adjacent to the particular aperture column of FIG. 10. By comparing FIGS. 10 and 11, it can be seen that the maximum amounts of transmitted energy through adjacent columns occur at different vertical locations.

The moiré effect, for a given mask structure period $T_y$, is a function of the period $T_s$ of the television signal and of its phase $\Phi$. The goal of minimizing moiré effect can be achieved by finding a value of $T_s$ that makes the energy passing across the mask and transmitted by each mask aperture independent of the phase $\Phi$ of the television signal. In such a case, the location of the television signal scanning lines, relative to the mask apertures, has no influence on the passed or transmitted energy.

To compute the energy passing through each individual mask aperture, an integral, over a period $T_y$, of the following function must be considered.

$$E(w_s,\phi)=\sum_{0}^{N-1} n\Delta(n)E_M(n). \tag{7}$$

By use of the derivative of E ($w_s$, $\Phi$) with respect to $\Phi$, the value of $w_s$ that minimizes the energy is found from the equation:

$$\frac{\partial E(w_s,\phi)}{\partial\phi}=\frac{m}{N}\sum_{0}^{N-1} N\sum_{0}^{N-1} kX_M(k)e^{J2\pi nk/N}\sin(w_s n+\phi)=0. \tag{8}$$

Because the derivative in Equation 8 is yet a function of the phase $\Phi$, it can be zero only if the modulus of its argument is zero. The modulus of this argument is given by the sum of the products $|X_M(k)||\sin(w_s n+\Phi)|$. But, $|\sin(w_s n+\Phi|$ equals either 0 or 1 only for a frequency $f_s$ which is equal to $$\frac{w_s}{2\pi}.$$

Then, in the sum of $|X_M(k)||\sin(w_s n+\Phi)|$, only the values $|X_M(k)|$, which correspond to the frequency $$f_s=\frac{w_s}{2\pi},$$

must be considered. The goal of minimizing equation (8) or the sum of the products $|X_M(k)||\sin(w_s n+\Phi)|$ is reached when a value of $$f_s=\frac{w_s}{2\pi}$$

is selected such that $|X_M(k)|$ is minimal or zero.

For a fully rectangular mask aperture, the modulus is zero when the aperture length h is equal to or a multiple of the scanning line period $T_s$. Therefore, the aperture length h that minimizes the moiré effect is, in terms of the period $$T_S=\frac{2\pi}{w_s}:$$

$$h=\text{a multiple of } T_S \text{ or preferably, } T_S. \tag{9}$$

As stated above, $T_S$ equals the vertical height of the screen divided by the number of effective scanning lines on the screen. For example, $$T_S=\frac{H}{550}$$

for a TV signal of 625 scanning lines.

Figure 12:
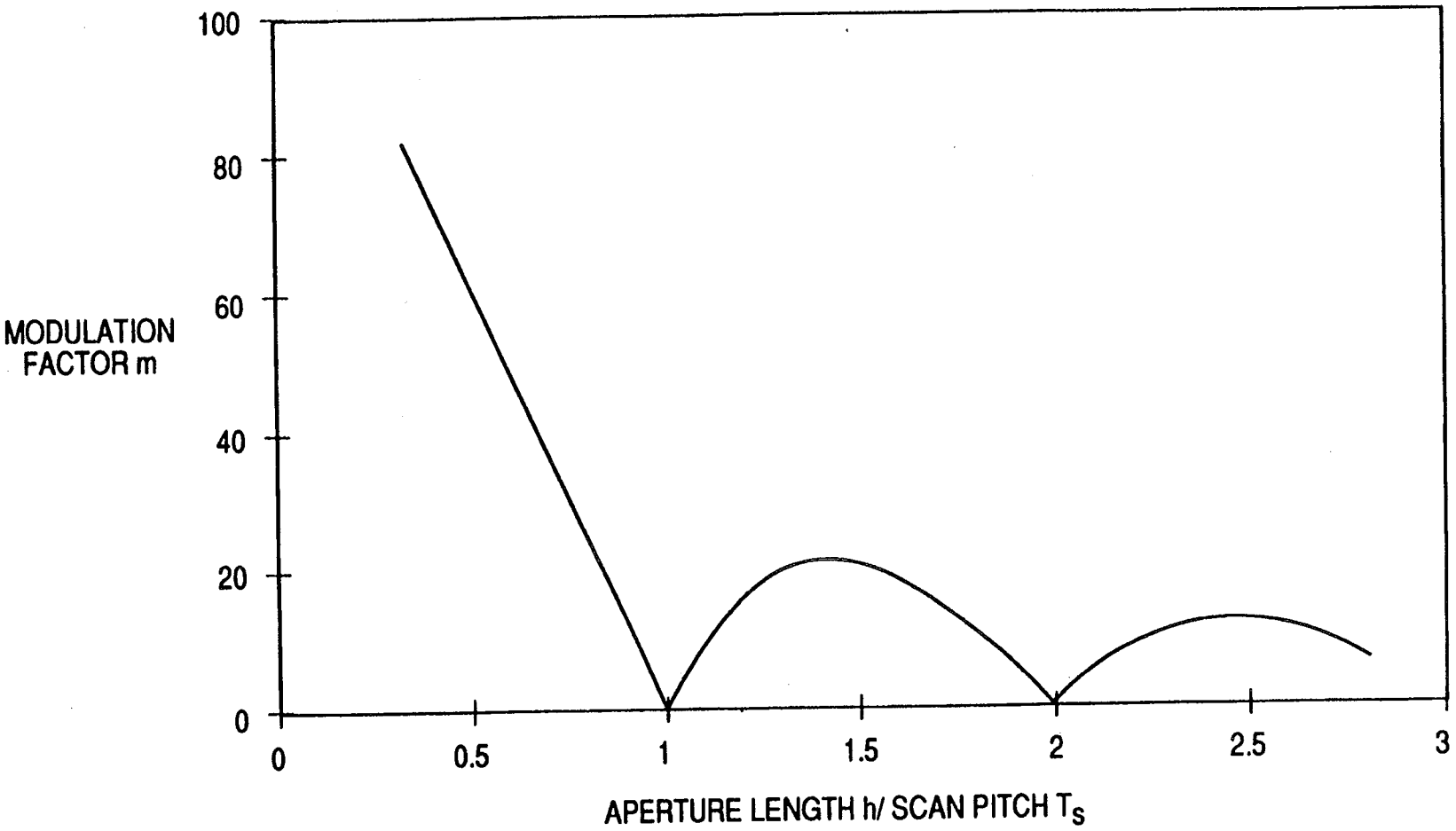
FIG. 12 is a graph of a modulation factor, m, verses a ratio of aperture length to scan line spacing.
Figure 13:
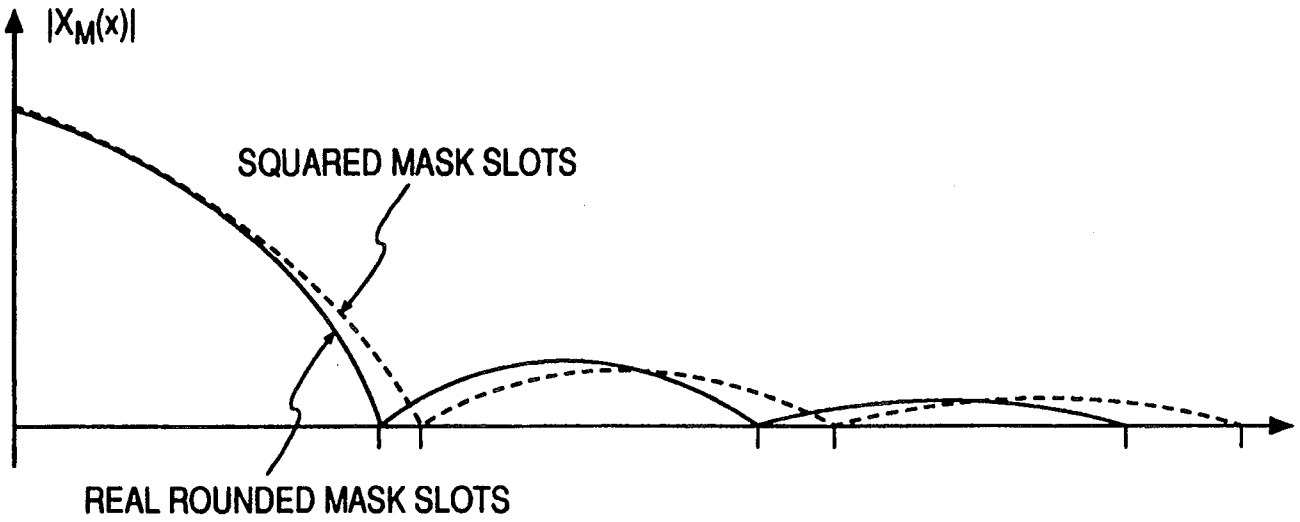
FIG. 13 is a graph of Fourier coefficients, X(k), for a mask having square ended apertures and a mask having rounded ended apertures.

FIG. 12 is a graph representing the modulation of the light through the apertures, in terms of the absolute value of the Fourier coefficients $|X_M(k)|$, versus the ratio of aperture vertical length h to $T_S$ (the height of the viewing screen divided by the number of effective scanning lines on the screen). The ratio of h to $T_S$ has the same values on a formed mask surface as on the front panel surface. If the mask aperture is not squared at its corners, the real rounded mask aperture structure is taken into account in the Fourier coefficients $X_M(k)$. By elaborating the $X_M(k)$ for the real mask structure, the selection of $T_S$ is made by putting $1/T_s$ in coincidence with the minimum of the modulus of $X_M(k)$, as shown in FIG. 13. In summary, for a given constant patterned mask, a proper $T_S$ may be selected which will be equal to the aperture length h of the slit-shaped mask apertures, if the ends of the apertures are squared, but $T_S$ will have a slightly different value if the ends of the apertures are not squared.

Figure 14:
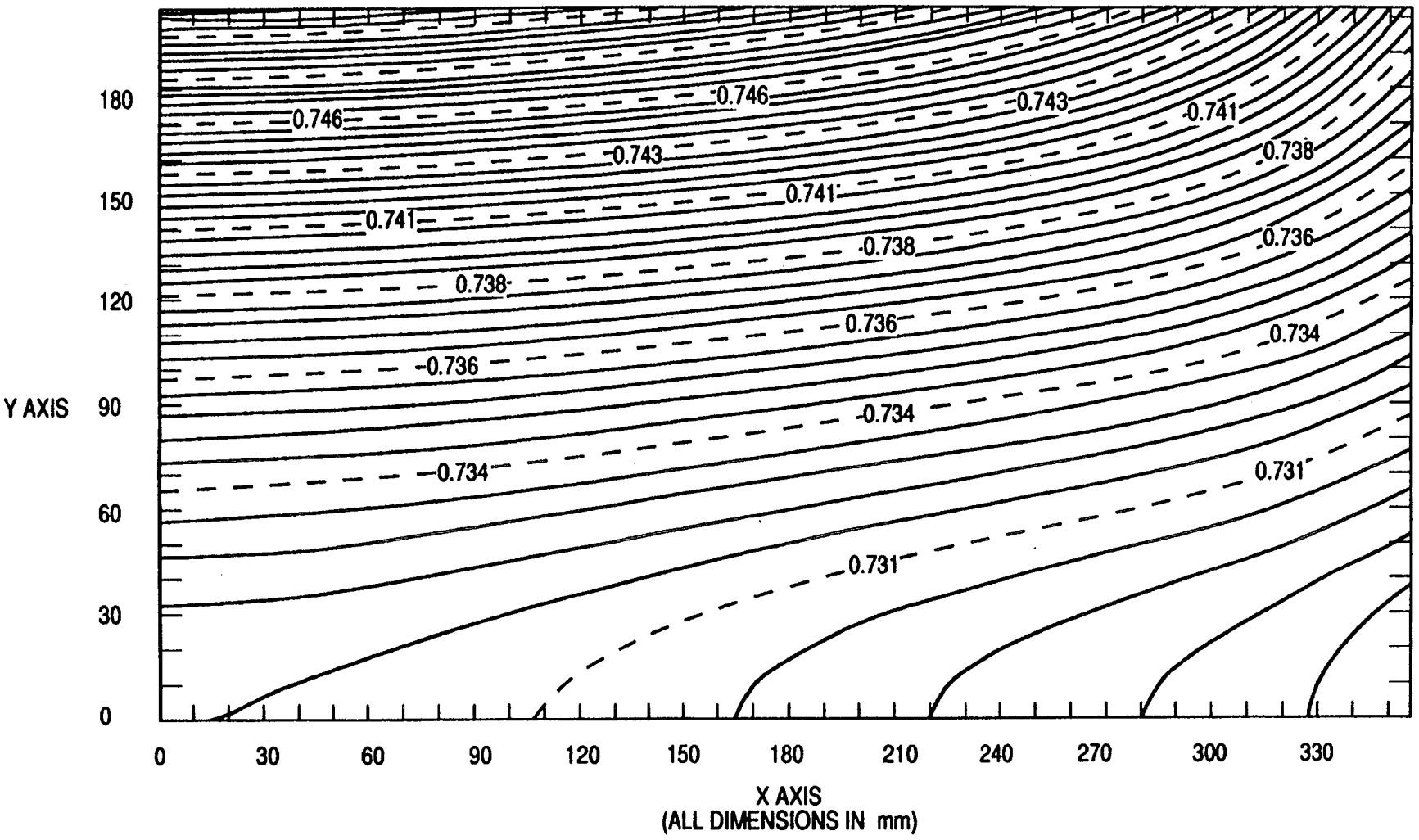
FIG. 14 is a graph showing aperture length distribution in a quadrant of a formed shadow mask, in accordance with the present invention.

FIG. 14 is a graph showing aperture lengths in the upper right quadrant of a formed shadow mask constructed in accordance with the present invention. This mask is used in a tube having a screen with an 86 centimeter diagonal dimension and a 16 by 9 aspect ratio. The lines on the graph, which are similar to contour lines, indicate locations of similar length apertures on the mask. All dimensions in FIG. 14 are given in millimeters.

What is claimed is:

1. In a color picture tube having a viewing screen, a shadow mask located adjacent to said screen, and an electron gun for generating and directing a plurality of electron beams through said mask to said screen, said mask having a rectangular periphery with two long sides and two short sides, with a major axis passing through the center of said mask and paralleling said long sides and a minor axis passing through the center of said mask and paralleling said short sides, and said mask including slit-shaped apertures aligned in columns that essentially parallel said minor axis, adjacent apertures in each column being separated by tie bars in said mask, and said beams being scanable over said screen in effective scanning lines that parallel said major axis, the improvement comprising the length of said apertures, measured in the direction of said minor axis, being approximately equal to a multiple of the center-to-center distance between adjacent scanning lines.

2. The tube as defined in claim 1, wherein the slit-shaped apertures have square ends, and said multiple is one.

3. The tube as defined in claim 1, wherein said multiple is approximately one.

* * * * *